US008641221B2

(12) United States Patent
Wright

(10) Patent No.: US 8,641,221 B2
(45) Date of Patent: Feb. 4, 2014

(54) ILLUMINATED EYEGLASSES

(76) Inventor: Clifford Wright, San Diego, CA (US)

( * ) Notice: Subject to any disclaimer, the term of this patent is extended or adjusted under 35 U.S.C. 154(b) by 89 days.

(21) Appl. No.: 13/306,843

(22) Filed: Nov. 29, 2011

(65) Prior Publication Data

US 2012/0134141 A1 May 31, 2012

Related U.S. Application Data

(60) Provisional application No. 61/418,364, filed on Nov. 30, 2010.

(51) Int. Cl.
*F21V 21/084* (2006.01)

(52) U.S. Cl.
USPC ..... 362/105; 362/103; 362/234; 362/253; 351/41; 351/59; 351/158

(58) Field of Classification Search
USPC ..... 362/103, 253, 105, 234; 351/41, 59, 351/158
See application file for complete search history.

(56) References Cited

U.S. PATENT DOCUMENTS 6,406,144 B1 * 6/2002 Waters ..... 351/56
2005/0225714 A1 * 10/2005 Thir ..... 351/59

* cited by examiner

*Primary Examiner* — Stephen F Husar
*Assistant Examiner* — Meghan Dunwiddie
(74) *Attorney, Agent, or Firm* — Fred C. Hernandez; Mintz Levin Cohn Ferris Glovsky and Popeo, P.C.

(57) ABSTRACT

An eyewear lighting mechanism includes a housing having a horizontal array of lights, the horizontal array of lights being mounted to pivot vertically. The housing contains a power source for the horizontal array of lights. The housing is connected to a base to allow the housing and the horizontal array of lights to pivot horizontally.

7 Claims, 6 Drawing Sheets

ILLUMINATED EYEGLASSES

REFERENCE TO PRIORITY DOCUMENT

This application claims priority of U.S. Provisional Patent Application Ser. No. 61/418,364, filed on Nov. 30, 2010, and entitled ILLUMINATED EYEGLASSES. The disclosure of the Provisional Patent Application is hereby incorporated by reference in its entirety.

BACKGROUND

The present disclosure relates to a lighting mechanism. More particularly the present disclosure relates to a portable lighting mechanism that can be mounted, for example, on a pair of glasses.

A person will often wear a pair of eyeglasses while performing a task or while participating in a sporting task, such as biking. It may often be desirable to have proper lighting to assist the user in proper vision during performance of the task. Often, general overhead lighting is not sufficient as the person performing the task may require lighting that is focused on a work area, or the person may be mobile such that fixed overheard lighting is not sufficient.

Consequently, the person performing the task will carry a separate lighting device, such as a flashlight or other handheld lighting device. This can be cumbersome, as the lighting device requires the use of the person's hand, which may be required for some other task. In view of the foregoing, there is a need for a lighting device, such as can be used with eyeglasses, that does not require the user to use his or her hand to hold the lighting device.

SUMMARY

This document discloses a lighting mechanism that can be easily handled and that can be mounted in or on a variety of locations such as on a pair of eyeglesses. In an embodiment, the lighting mechanism includes aimable lights that can be pivoted up and down as well as side-to-side, and which are self-contained within a single housing that can be mounted on any object, such as a pair of eyeglasses.

In one aspect, a lighting mechanism includes a housing having a horizontal array of lights, the horizontal array of lights being mounted to pivot vertically. The housing contains a power source for the horizontal array of lights. The housing is connected to a base to allow the housing and the horizontal array of lights to pivot horizontally.

In another aspect, a lighting mechanism includes a housing having a subsection provided at a boundary of the housing. The subsection contains a set of lights and being adapted to pivot up and down with respect to the housing. The housing further includes a power source connected to power the set of lights. The housing is mounted to a base that allows the housing to rotate side-to-side with respect to the base.

In another aspect, there is disclosed a lighting mechanism comprising: a main housing; a subsection attached to the housing, the subsection being pivotably mounted on the housing about a horizontal axis such that the subsection can rotate vertically about the horizontal axis; an array of lights positioned on the subsection; a power source in the housing adapted to power the array of lights; and a base movably attached to the main housing, wherein the main housing can rotate relative to the base about a vertical axis The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

DETAILED DESCRIPTION

This document describes a set of glasses that includes at least one lighting mechanism including a set of lights and a power source in a common housing. Part of the housing of the lighting mechanism is adapted to pivot about an axis, such as a vertical axis, such that the set of lights illuminate in a direction that ranges from horizontal to vertical from the major axis of the housing. In some implementations, the set of lights are arranged as a horizontal array of lights along a side of the housing.

Before the present subject matter is further described, it is to be understood that this subject matter described herein is not limited to particular embodiments described, as such may of course vary. It is also to be understood that the terminology used herein is for the purpose of describing particular embodiments only, and is not intended to be limiting. Unless defined otherwise, all technical terms used herein have the same meaning as commonly understood by one skilled in the art to which this subject matter belongs.

As will be apparent to those of skill in the art upon reading this disclosure, each of the individual embodiments described and illustrated herein has discrete components and features which may be readily separated from or combined with the features of any of the other several embodiments without departing from the scope of the subject matter described herein. Any recited method can be carried out in the order of events recited or in any other order which is logically possible.

Figure 1:
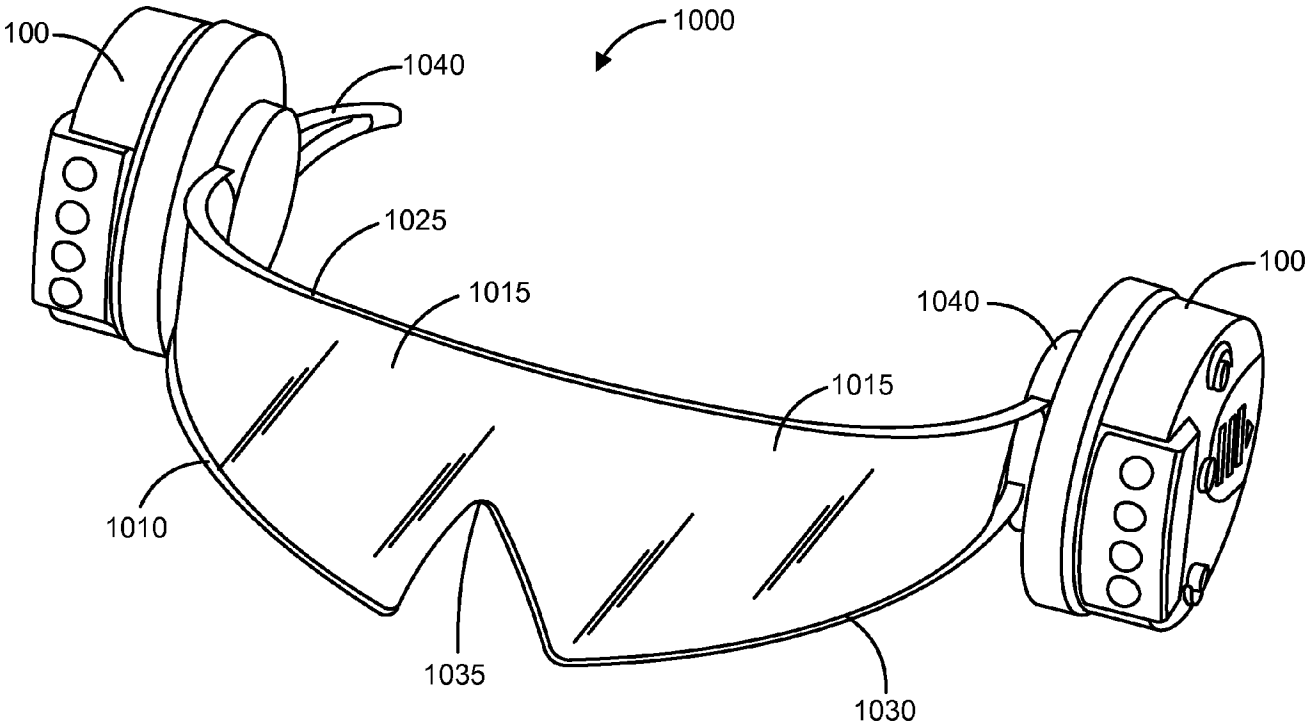
FIG. 1 is a perspective view of a pair of glasses.
Figure 2:
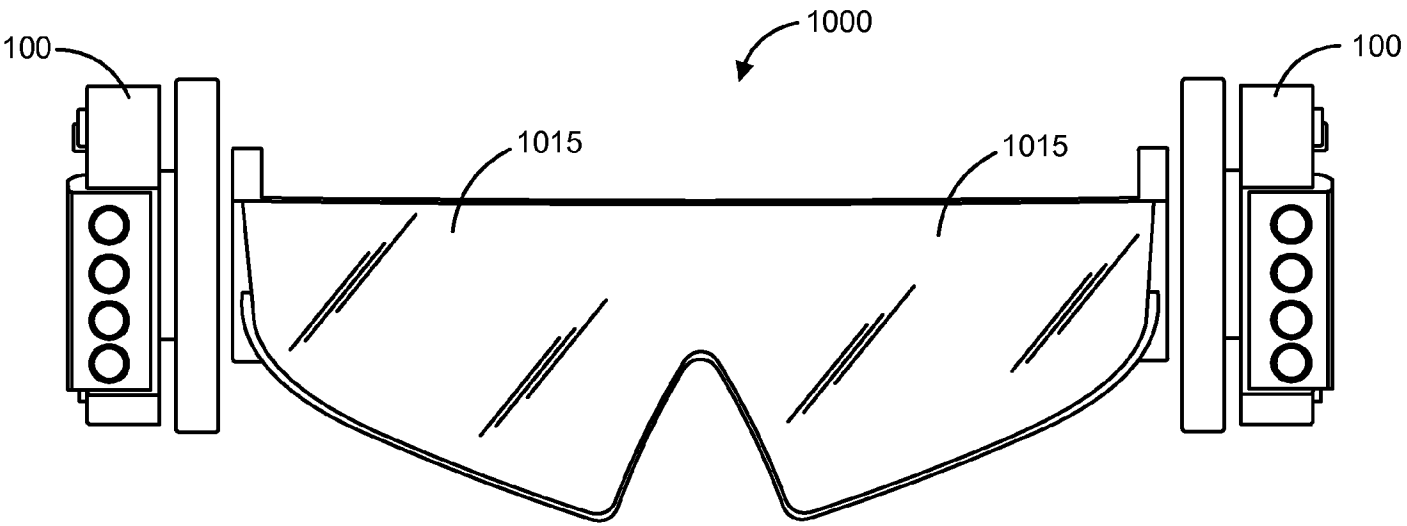
FIG. 2 is a front view of the glasses.
Figure 3:
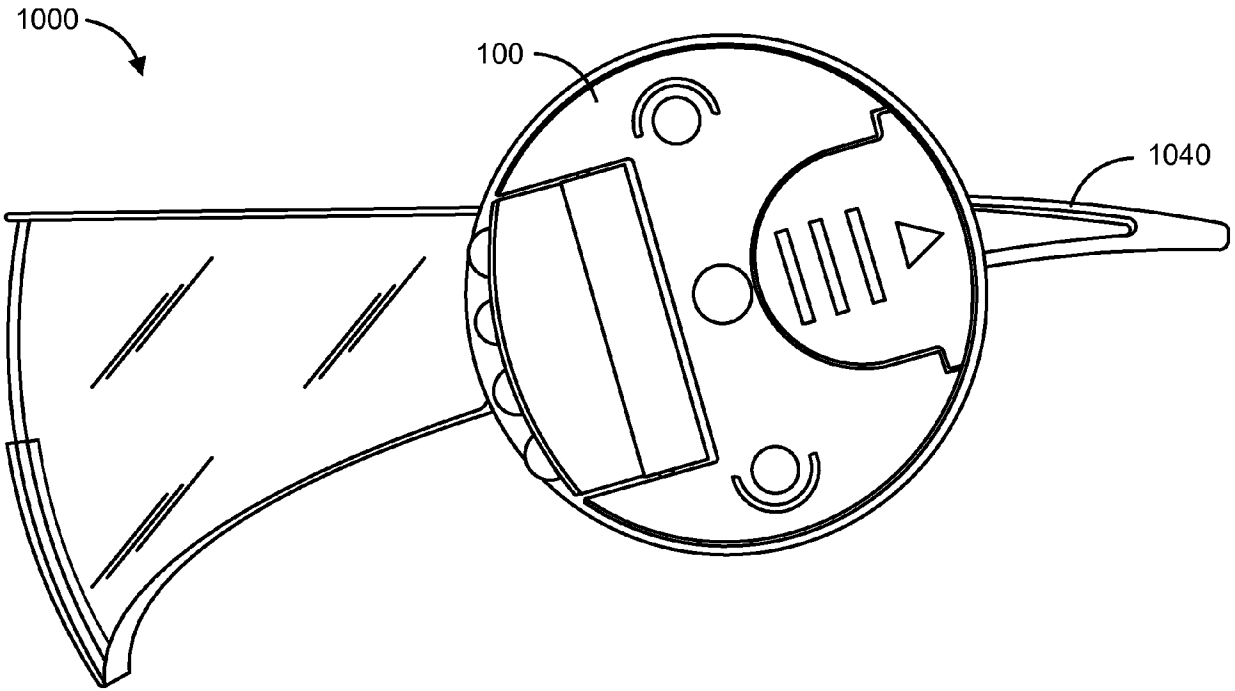
FIG. 3 is a side view of the glasses.

FIG. 1 shows a perspective view of an exemplary embodiment of a set of eyeglasses. FIGS. 2 and 3 show front and side views, respectively, of the eyeglasses 1000. The eyeglass 1000 generally comprises a frame 1010 which, in the illustrated embodiment, supports a pair of lenses 1015. Although the glasses will be described with reference to a single lens system, it is to be understood that the methods and principles discussed herein are readily applicable to the production of frames for multi-lens eyeglass systems and protective goggle systems as well.

The frame 1010 generally comprises a first orbital 1025 and a second orbital 1030 for supporting the lens 1015. Although the present invention will be disclosed in the context of a single orbital which surround the lens, the principles of the present invention also apply to eyeglass systems in which the frame only partially surrounds the lens or lenses, or contacts only one edge or a portion of one edge of the lens or each lens as well or that have multiple oribitals.

In the illustrated embodiment, the orbitals 1025, 1030 are connected by a bridge portion 1035. The eyeglass 1000 is also provided with a pair of generally rearwardly extending earstems 1040 for retaining the eyeglass on the head of the wearer. In addition, an open region is adapted to receive the nose of the wearer, as is understood in the art. Nose region may optionally be provided with a nosepiece, either connected to the lens orbitals, or the bridge, or directly to the lens(s) depending upon the particular embodiment. Alternatively, the nosepiece may be formed by appropriately sculpting the medial edges of the orbitals and lower edge of the bridge, as in the illustrated embodiment.

At least the orbitals and optionally the bridge, as well as other components of the eyeglass system, are manufactured from a high structural integrity material. The manufacturing process may comprise a casting process to optimize structural stability in at least the optical support portion of the final product. The orbitals can be separately formed and assembled later with a separately manufactured bridge or the orbitals can be integrally molded or cast as will be appreciated by one of skill in the art in view of the disclosure herein. Casting the eyeglass components directly into the final configuration as disclosed herein desirably eliminates the need to bend metal parts as is done in the prior art methods of making and adjusting metal eyeglass frames.

The glasses 1000 include at least one lighting mechanism 100 that is mounted on the glasses 1000. In the illustrated embodiment, the glasses 1000 include a pair of lighting mechanisms 100 with a first lighting mechanisms 100 mounted on one of the earstem 1040 and a second lighting mechanisms 100 mounted on the other earstem 1040. In this manner, the lighting mechanisms 100 can be positioned and oriented such that a direction of light emission tracks the vision direction of the wearer. It should be appreciated that the lighting mechanism can be disposed on other locations on the glasses 1000.

In some implementations, as illustrated in FIGS. 3-6, the lighting mechanism comprises a set of lights that includes four lights arranged horizontally along a side of a housing, in a subsection of the housing that pivots independently of the rest of the housing. The subsection is connected on ends by a hinge or other pivoting mechanism that allows the subsection to pivot such that the set of lights illuminates in a direction ranging from horizontal to vertical with respect to the major axis of the housing.

Figure 4:
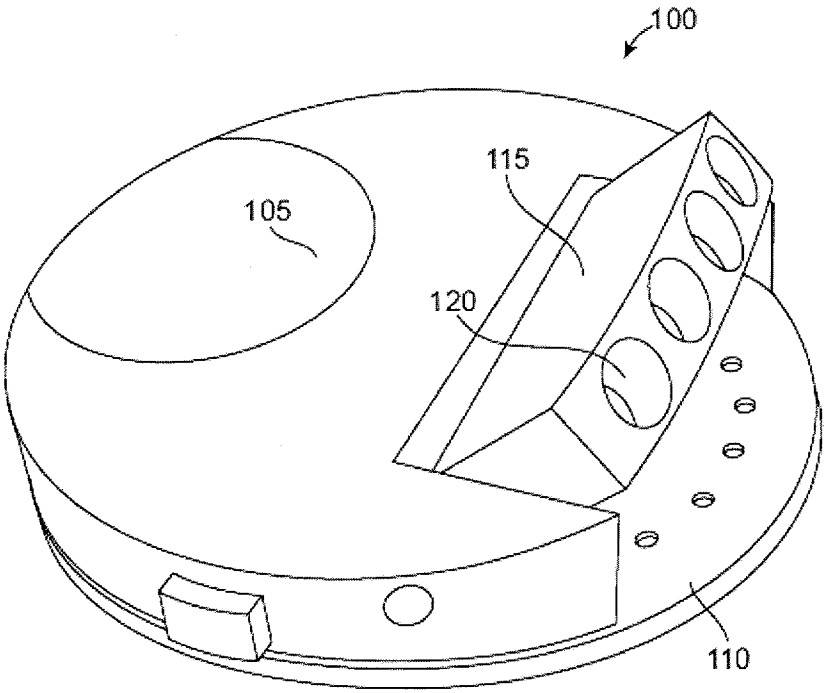
FIG. 4 is a side perspective view of a lighting mechanism of the glasses.
Figure 5:
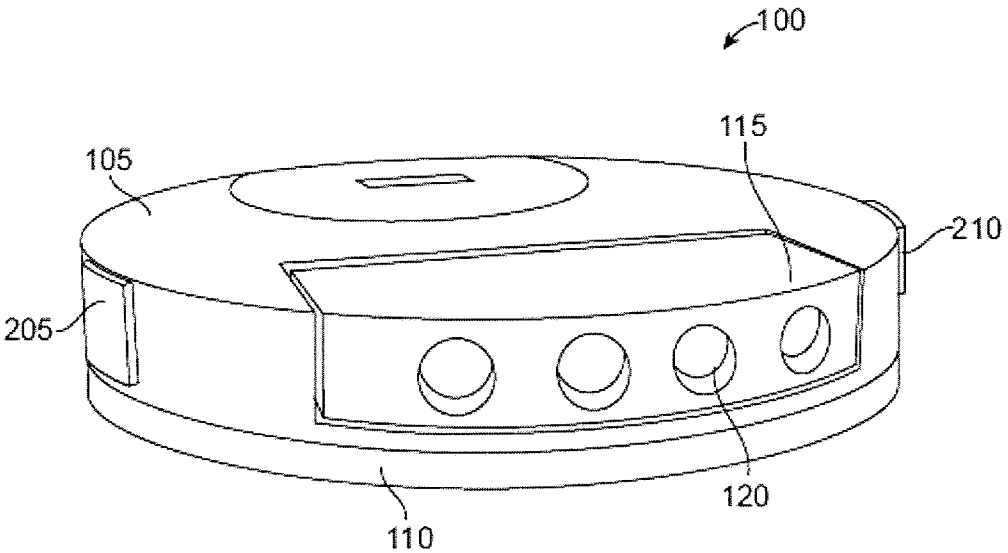
FIG. 5 is a front perspective view of a lighting mechanism.

FIG. 4 is a side perspective view of an exemplary embodiment of the lighting mechanism 100. FIG. 5 shows a front perspective view of the lighting mechanism 100. The lighting mechanism 100 includes a main housing 105 that is rotatably mounted on a base 110. In an embodiment, the main housing 105 can be detached and re-attached to the base 110. The main housing 105 includes a movable subsection 115 having one or more lights 120. In an embodiment, the lights 120 are arranged in a horizontal array of lights. The main housing 105 and base 110 are circular or cylindrical in shape although it should be appreciated that the shape can vary.

The subsection 115 is movably attached to the main housing 105. In this regard, the subsection 115 is pivotably attached to the main housing such that the subsection 115 (and the lights 120) can rotate vertically to vary the vertical direction in which the lights 120 are pointing. In an embodiment, the subsection 115 rotates about a horizontal axis with the base 110 being aligned along a horizontal plane. As shown in the cross-sectional view of FIG. 3, a pivot pin 310 can be used to pivotably attach the subsection 115 to the housing 105.

Figure 6:
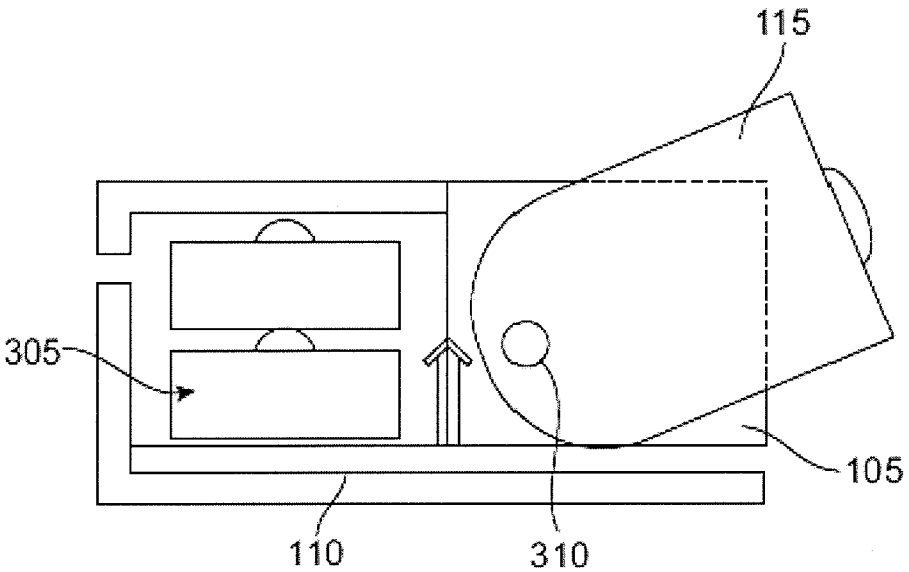
FIG. 6 is a cutaway view of a lighting mechanism.

FIG. 6 shows a cross-sectional view of the lighting mechanism 100 from the side. The housing 105 includes at least one power source 305 for powering the set of lights 120. The power source 305 can include one or more batteries, such as lithium or nickel cadmium. Alternatively, the housing 105 can include a solar energy source having one or more solar panels. The housing 105 is mounted to the base which allows the housing to pivot about a vertical, or minor, axis. In some implementations, the housing can pivot up to 90 degrees in either direction from a starting direction.

The housing 105 can include one or more actuators. For example, as shown in FIG. 5, a first button 205 on the side of the housing 105 can be activated to release the housing 105 from being stationary on the base 110 and to pivot. That is, when the button 205 is in a first position, the housing 105 is locked relative to the base 110 such that the housing 105 can't move relative to the base. When the button 205 is in a second position, the housing 105 is free to rotate about an axis that is perpendicular to the base 110. This permits the orientation of the lights 120 to be adjusted. A second button 210 on the side of the housing 105 can be activated to control the set of lights 120. In some implementations, the first and second buttons can protrude from a side of the housing. Alternatively, one or both of the buttons can be a touch-sensitive area on the housing. Other actuation mechanisms can also be used.

The base 110 can be removably mounted to any of a number of objects such as the glasses 1000. The base 110 can include any of a variety of means for attaching the base 110 to the objects. For example, the base 110 can include adhesive, screws, magnets, etc. The base 110 of the lighting mechanism can be attached to the glasses in a variety of manner, including adhesive, bolts, screws, magnetic attachment, to enable a user to illuminate an area in a desired direction. In an embodiment, the lighting mechanism can be attached to the glasses, removed from the glasses, and then re-attached to the glasses. The illuminated direction can be changed by pivoting the subsection 115 of the housing 110 up or down from the rest of the housing 110, or by rotating the housing 110 relative to the base 110. In an embodiment, the lighting mechanism attaches to a round or rounded disk portion on the frame that allows the lighting mechanism to be attached and detached, such as by using a magnet. In this regard, the disk may be a metal.

The lighting mechanism housing can be made of plastic or other rigid, durable material. The lights can be halogen, light emitting diodes, or incandescent lamps, or other light source. The housing can include a removable cover for access to the power supply, i.e. to insert or remove the batteries. In some implementations, the housing and subsection can be formed to create a low-profile cylinder. In other implementations, the housing can have rounded edges and sides. Those having skill in the art will recognize, however, that the housing and subsection for the set of lights can be of any shape or dimensions.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

Although a few embodiments have been described in detail above, other modifications are possible. Other embodiments may be within the scope of the following claims.

The invention claimed is:

1. A pair of glasses, comprising:

a frame having a pair of earstems;

a lens mounted in the frame;

a lighting mechanism attached to the frame, the lighting mechanism comprising:

a main housing;

a subsection attached to the housing, the subsection being pivotably mounted on the housing about a horizontal axis such that the subsection can rotate vertically about the horizontal axis;

an array of lights positioned on the subsection;

a power source in the housing adapted to power the array of lights;

a base comprising a magnet and movably attached to the main housing, wherein the main housing can rotate relative to the base about a vertical axis.

2. A lighting mechanism as in claim 1, wherein the array of lights comprises a plurality of lights arranged in a horizontal row.

3. A lighting mechanism as in claim 1, wherein the subsection pivots up to a range of 90 degrees about the horizontal axis.

4. A lighting mechanism as in claim 1, wherein the array of lights comprises light emitting diodes.

5. A lighting mechanism as in claim 1, wherein the main housing locks in a fixed position relative to the base.

6. A lighting mechanism as in claim 1, wherein the base is removably attached to the frame such that the base can be reattached to the frame after detachment from the frame.

7. A pair of glasses, comprising:

a frame having a pair of earstems;

a lens mounted in the frame;

a lighting mechanism attached to the frame, the lighting mechanism comprising:

a main housing;

a subsection attached to the housing, the subsection being pivotably mounted on the housing about a horizontal axis such that the subsection can rotate vertically about the horizontal axis;

an array of lights positioned on the subsection;

a power source in the housing adapted to power the array of lights;

a base movably attached to the main housing, wherein the main housing can rotate relative to the base about a vertical axis and the base is removably attached to the frame such that the base can be reattached to the frame after detachment from the frame.

* * * * *